US011034558B2

(12) United States Patent
Paulig

(10) Patent No.: US 11,034,558 B2
(45) Date of Patent: Jun. 15, 2021

(54) METHOD AND SYSTEM FOR CONTROLLING THE WINDING/UNWINDING OF A ROPE PORTION ONTO/FROM A ROTARY DRUM

(71) Applicant: SkySails Power GmbH, Hamburg (DE)

(72) Inventor: Xaver Paulig, Hamburg (DE)

(73) Assignee: SkySails Power GmbH, Hamburg (DE)

( * ) Notice: Subject to any disclaimer, the term of this patent is extended or adjusted under 35 U.S.C. 154(b) by 477 days.

(21) Appl. No.: 16/157,297

(22) Filed: Oct. 11, 2018

(65) Prior Publication Data

US 2019/0112169 A1 Apr. 18, 2019

(30) Foreign Application Priority Data

Oct. 16, 2017 (EP) ..... 17196595

(51) Int. Cl.
*B66D 1/50* (2006.01)
*B66D 1/48* (2006.01)
*B63H 9/069* (2020.01)

(52) U.S. Cl.
CPC ..... *B66D 1/505* (2013.01); *B63H 9/069* (2020.02); *B66D 1/485* (2013.01)

(58) Field of Classification Search
CPC ..... B66D 1/505; B66D 1/485; B66D 1/36; B63H 9/096; B64C 39/022
USPC ..... 244/155 A
See application file for complete search history.

(56) References Cited

U.S. PATENT DOCUMENTS

2007/0272141 A1* 11/2007 Wrage ..... B63H 9/069 114/111
2010/0013225 A1* 1/2010 Ippolito ..... F03D 5/00 290/44
2012/0182130 A1* 7/2012 Sarchi ..... D07B 1/145 340/10.1
2014/0027691 A1* 1/2014 Ilaka ..... B66D 1/30 254/334
2014/0339832 A1* 11/2014 Goldstein ..... F03D 13/25 290/55

(Continued)

FOREIGN PATENT DOCUMENTS

CN 203855344 10/2014
EP 0103162 3/1984

(Continued)

*Primary Examiner* — Christopher P Ellis
(74) *Attorney, Agent, or Firm* — Alix, Yale & Ristas, LLP

(57) ABSTRACT

A method and a system for controlling the winding/unwinding of a rope portion onto/from a rotary drum, comprises the step of making available a rope which is at least partially wound onto a rotary drum, wherein the rope is guided from the rotary drum along a defined path as far as a hauling point, wherein a traction force acts on the rope beyond the hauling point. The method comprises unwinding or winding the rope by executing a rotation of the rotary drum, such that a defined rope portion is moved along the defined path; and determining the length of the defined rope portion in the region of the defined path. The method comprises determining an angle difference corresponding to the rotation of the rotary drum; and controlling the rotary drum for further winding/unwinding taking into account the length and the angle difference. A calibration in the region of the defined path during the use of the rotary drum provides a control for the rotary drum.

20 Claims, 1 Drawing Sheet

(56) References Cited

U.S. PATENT DOCUMENTS

| | | | | |
|---|---|---|---|---|
| 2015/0274260 | A1* | 10/2015 | McCabe | B63G 8/001 114/44 |
| 2015/0375975 | A1* | 12/2015 | Flateland | B66D 1/36 254/310 |
| 2016/0031685 | A1* | 2/2016 | Lawson | B66D 1/7442 414/800 |
| 2016/0347594 | A1* | 12/2016 | Shmueli | B66D 1/7457 |
| 2020/0118530 | A1* | 4/2020 | Bedson | G10D 13/16 |
| 2020/0131011 | A1* | 4/2020 | Holmberg | B66D 1/485 |
| 2020/0140245 | A1* | 5/2020 | Yasuda | B66D 1/485 |
| 2021/0009285 | A1* | 1/2021 | Talke | B66D 1/7489 |
| 2021/0061487 | A1* | 3/2021 | Briggs, IV | B66D 1/505 |
| 2021/0070590 | A1* | 3/2021 | Iwashita | B66D 1/36 |

FOREIGN PATENT DOCUMENTS

| | | | | |
|---|---|---|---|---|
| EP | 2567930 | A1 * | 3/2013 | B66D 1/36 |
| EP | 3686149 | A1 * | 7/2020 | B66C 13/105 |
| WO | WO2005100150 | | 10/2005 | |
| WO | WO-2019038475 | A1 * | 2/2019 | B66D 1/38 |

* cited by examiner

METHOD AND SYSTEM FOR CONTROLLING THE WINDING/UNWINDING OF A ROPE PORTION ONTO/FROM A ROTARY DRUM

BACKGROUND

The present invention relates to a method and a system for controlling the winding/unwinding of a rope portion onto/from a rotary drum.

It is known in the prior art to use a rotary drum in order to wind/unwind a rope onto/from said rotary drum. Such rotary drums usually have a circular cylindrical winding surface onto which the rope can be wound during rotation of the drum, and thus stored in a space-saving manner, and from which the rope can be unwound again when so required. The unwinding is effected by a reverse rotation of the rotary drum. Such rotary drums are used, for example, to pay out (unwind) a traction rope, on which a wind-attacked element designed to fly freely is held, and to haul in (wind up) said rope. In such applications, the hauling in and paying out of the traction rope has to be carried out with the greatest possible precision. This applies in particular when hauling in the traction rope in preparation for landing the wind-attacked element, when the wind-attacked element is hauled in and docked to a landing device.

In the prior art, the length of a rope portion unwound from the rotary drum or wound onto the rotary drum is customarily determined via the rotation angle of the rotary drum during the winding procedure. Since the rope on the rotary drum is usually wound up in a circular formation, the length L of the wound/unwound rope portion can be determined using the formula $$L = \alpha \frac{2\pi r}{360},$$

where $\alpha$ denotes the respective rotation angle and r denotes the "radius of the winding profile", i.e. the distance between the rotation axis of the rotary drum and the point at which the rope merges into the winding. However, it has been shown that this kind of determination of the unwound or wound rope portion often fails to provide the required precision.

Against this background, a method and a system are provided for controlling the winding/unwinding of a rope portion onto/from a rotary drum.

SUMMARY

A method comprises the following steps:

a. making available a rope which is at least partially wound onto a rotary drum, wherein the rope is guided from the rotary drum along a defined path as far as a hauling point, wherein a traction force acts on the rope beyond the hauling point;
b. unwinding or winding the rope by executing a rotation of the rotary drum, such that a defined rope portion is moved along the defined path;
c. determining the length of the defined rope portion in the region of the defined path;
d. determining an angle difference corresponding to the rotation executed in step b.; and e. controlling the rotary drum for further winding/unwinding taking into account the parameters determined in steps c. and d.

Certain terms used in the context of the invention will first be explained. In the context of the invention, the hauling point is a point at which the rope is limited in its mobility in the sense that, under the effect of a traction force acting beyond the hauling point, the rope extends on the defined path between the rope feed position of the rotary drum (i.e. a point at which the rope leaves the rotary drum) and the hauling point, i.e. is tensioned between the drum and the hauling point. In this way, the rope is guided along the defined path, even if the rope is subjected to a traction force whose direction encloses an angle with the defined path. For example, the hauling point can be a deflection point, which is formed by a deflection roller, for example. The defined path usually runs in a straight line from the rope feed position of the rotary drum as far as the hauling point. It is also possible that the rope is deflected along the defined path by rollers, for example.

The invention is based on the recognition that the simple assignment of the rotation angle to an unwound/wound length portion of rope, as per the prior art, often leads to inaccurate results. This is due, among other things, to the fact that the rope can stretch plastically and/or elastically during use and thus undergoes a change of length. A plastic elongation leads to a permanent lengthening of the rope. This occurs, for example, in synthetic fiber ropes, particularly at the start of the period of use of such ropes. In addition, a load-dependent elastic change of length can occur, in which case the rope lengthens when a traction force acts on it and shortens again in a reversible manner when the traction force subsides.

Said changes of length can have the effect that a rotation angle of the rotary drum cannot be clearly assigned to an unwound or wound portion of traction rope.

In the context of the invention, it has also been recognized that the effective drum circumference of a winding profile, which is generated by winding the rope onto the rotary drum, may depend on the traction force that is present during the winding-up process. The effective drum circumference designates the length of a rope portion that is unwound or wound up during a 360° revolution of the rotary drum. If the rope is elongated elastically on account of relatively high traction forces during the winding-up process, this can lead to a reduction of the effective drum circumference, especially when the rope is wound up in multiple layers, since the rope diameter decreases on account of the elongation. Alternatively or additionally, the effective drum circumference may also be influenced by the nature of the winding or, for example, by winding errors.

Against this background, it is proposed that a rope is guided from the rotary drum along a defined path as far as a hauling point, such that the rope, during the unwinding or winding process, extends between the rotary drum and the hauling point along the defined path. It is thus easily possible, in the region of the defined path, to determine the length of a defined rope portion that is unwound or wound up by the rotation of the rotary drum and at the same time to determine the associated angle difference. A measurement is allowed to be carried out during the use of the rotary drum, which measurement can be taken directly into consideration in the further control of the rotary drum, in order to improve the precision of the control. Changes of length of the rope (in particular changes of length dependent on traction force) that occur in the unwinding or winding process during use can be taken directly into consideration, and a calibration can take place during use in order to control the rotary drum with increased precision.

In a preferred embodiment, the rope has a first marking and a second marking spaced apart from the first one, wherein the defined path has a sensor position. In step b. the rope is preferably unwound or wound up such that the first marking passes the sensor position and the second marking passes or at least reaches the sensor position, wherein the first marking and the second marking are detected as they pass or reach the sensor position. The length in step c. is preferably determined by the spacing of the markings, wherein the angle difference between the angle position of the rotary drum upon detection of the first marking and the angle position of the rotary drum upon detection of the second marking is determined. In this embodiment, the invention thus proposes using a rope with two markings spaced apart from each other. During the unwinding or winding up of the rope by rotation of the rotary drum, the markings can be guided past the sensor position in a defined manner, namely along the defined path, and can be detected there. At the same time, it is possible to determine the angle difference effected by the rotary drum between the detection of the first marking and the detection of the second marking. This angle difference can then be set in relation to the spacing between the two markings and thus taken into account in the further control. Since the spacing of the markings is known, the method thus allows a calibration to be performed, such that a rope portion of desired length can be unwound or wound up in an exact manner by suitable rotation of the rotary drum.

Since a traction force acts on the rope during the unwinding or winding of the rope, the rope may, as has been explained above, undergo an elastic elongation dependent on the traction force, which elongation influences the spacing between the markings. Thus, in the calibration explained above, an error can arise if the length of the defined rope portion is determined by the spacing of the markings. Provision can therefore be made that the spacing between the markings is corrected on the basis of a rope elongation. For example, the spacing between the markings can be re-measured, for example in a state in which no traction force acts on the rope. A plastic elongation of the rope in the region between the markings can be ascertained in this way. An elastic elongation of the rope can be assessed, for example, on how strong the traction force acting on the rope is during the detection of the markings. For this purpose, a force sensor can be provided for measuring the traction force acting on the rope, wherein an elastic elongation of the rope can be assessed from the traction force.

In order to avoid the error mentioned above, provision can be made in an alternative embodiment that the rope has one marking, wherein the defined path has a first sensor position and a second sensor position spaced apart from the first one, wherein in step b. the rope is unwound or wound up such that the marking passes the first sensor position and passes or at least reaches the second sensor position. The marking is preferably detected as it passes or reaches the sensor positions, wherein the length in step c. is determined by the spacing of the sensor positions (measured along the defined path), and wherein the angle difference between the angle position of the rotary drum upon detection of the marking at the first sensor position and of the angle position of the rotary drum upon detection of the marking at the second sensor position is determined. In this embodiment, two sensor positions are thus provided, wherein the rope does not necessarily need to have two markings; an individual marking is sufficient to carry out the method. The abovementioned measurement error can thereby be avoided. However, it is more cost-effective to use just one sensor position (and two markings), since then one sensor can be saved.

In an advantageous embodiment, the traction force is exerted by a wind-attacked element configured to fly freely and secured to the rope. From the free-flying state, the wind-attacked element can preferably be docked onto a docking adapter by hauling in the rope, wherein the detection of the marking or of the markings is preferably effected during the hauling-in of the rope, and wherein the wind-attacked element is docked taking into account the parameters determined in steps c. and d. A wind-attacked element of this kind, designed for docking to a docking adapter, is known from WO2005/100150A1 for example. The method herein permits a particularly exact hauling-in of the traction rope, such that the rope can easily be hauled in as far as is necessary for docking the wind-attacked element. The docking procedure can be greatly expedited in this way, and in addition the danger of collision with the docking adapter is reduced or avoided.

The present invention moreover relates to a system for controlling the winding/unwinding of a rope portion onto/from a rotary drum, said system comprising a rotary drum with a rope that can be wound onto/unwound from the rotary drum, and with an angle sensor for detecting a rotation angle of the rotary drum and for outputting an angle signal, characterized in that the system moreover has a hauling point, a length-measuring device and a control unit, wherein the rope is guided from the rotary drum along a defined path to the hauling point, wherein the length-measuring device is configured to determine the length of a defined rope portion extending along the defined path upon rotation of the rotary drum and to output a length signal, wherein the control unit is configured to receive the angle signal and the length signal and also to control the rotary drum taking into account the length signal and the angle signal.

In one embodiment, the length-measuring device has a sensor, wherein the rope has a first marking and a second marking spaced apart from the first one, wherein the sensor for detecting the markings is arranged in the region of the defined path and is configured to output a first length signal upon detection of the first marking and to output a second length signal upon detection of the second marking, wherein the control unit is configured to determine an angle difference on the basis of the angle signal and the length signals.

In an alternative embodiment, the length-measuring device has a first sensor and a second sensor spaced apart from the first one, wherein the rope has a marking, wherein the first sensor for detecting the marking is arranged in the region of the defined path and is configured to output a first length signal, wherein the second sensor for detecting the marking is arranged in the region of the defined path and is configured to output a second length signal, wherein the control unit is configured to determine an angle difference on the basis of the angle signal and the length signals.

The system can be refined by further features which have already been described in conjunction with the method. In particular, the system can be configured for carrying out the method.

The detection of the markings by the sensor can be effected by optical, electromagnetic or mechanical means, for example. In an advantageous embodiment, the at least one marking is formed by a metallic element integrated in the rope, wherein the sensor is configured as an inductive sensor.

The system can have a wind-attacked element connected to the rope and configured to fly freely. From the free-flying state, the wind-attacked element can preferably be docked to a docking adapter by hauling in the rope.

The spacing between the first marking and the second marking can be, for example, between 1 m and 30 m, preferably between 2 m and 20 m, more preferably between 5 m and 15 m. It has been shown that spacings in this range are advantageous in particular when using the system to recover (i.e. to land and dock) a wind-attacked element, since sufficient precision can be achieved in the control of the rotary drum.

In the case where the system has two sensors, these can have a spacing (measured along the defined path) of between 0.1 m and 5 m, preferably 0.2 m and 3 m, more preferably between 1 m and 2 m.

Additionally, in order to improve the control precision, the marking or markings can be used as indicators of how far the rope has already been hauled in. For this purpose, provision can be made that the marking or markings are arranged at a defined position of the rope. For example, the markings can be arranged near the end of the rope remote from the rotary drum such that, as the rope is being hauled in, an indication is given that the rope has been hauled in almost completely. During use with a wind-attacked element, the marking or markings can have a defined spacing from a securing point at which the rope is connected to the wind-attacked element. In a preferred embodiment, provision is made that the marking or, in the case of two markings, the marking lying remote from the rotary drum, is spaced apart from a securing point at which the rope is connected to the wind-attacked element, said spacing being between 5 m and 40 m, preferably between 10 m and 30 m, and more preferably between 15 m and 25 m. The closer the markings to the securing point, the more precise the subsequent docking to the docking adapter after detection of the markings.

Moreover, provision can be made that the spacing between the marking lying remote from the rotary drum and the sensor position is at least 2 m, preferably at least 4 m, more preferably at least 5 m, when the wind-attacked element is docked to the docking adapter. The spacing is in this case measured along the rope. This embodiment ensures that, as the wind-attacked element is being hauled in, the remote marking is detected by the sensor well before the docking position is reached. In this embodiment, the wind-attacked element can be hauled in with great precision and can be braked after the remote marking is detected by the sensor, wherein the abovementioned minimum spacings ensure that the wind-attacked element can be safely braked before the docking adapter is reached.

BRIEF DESCRIPTION OF THE DRAWINGS

Advantageous embodiments of the invention are explained by way of example below with reference to the attached drawings, in which.

DETAILED DESCRIPTION

Figure 1:
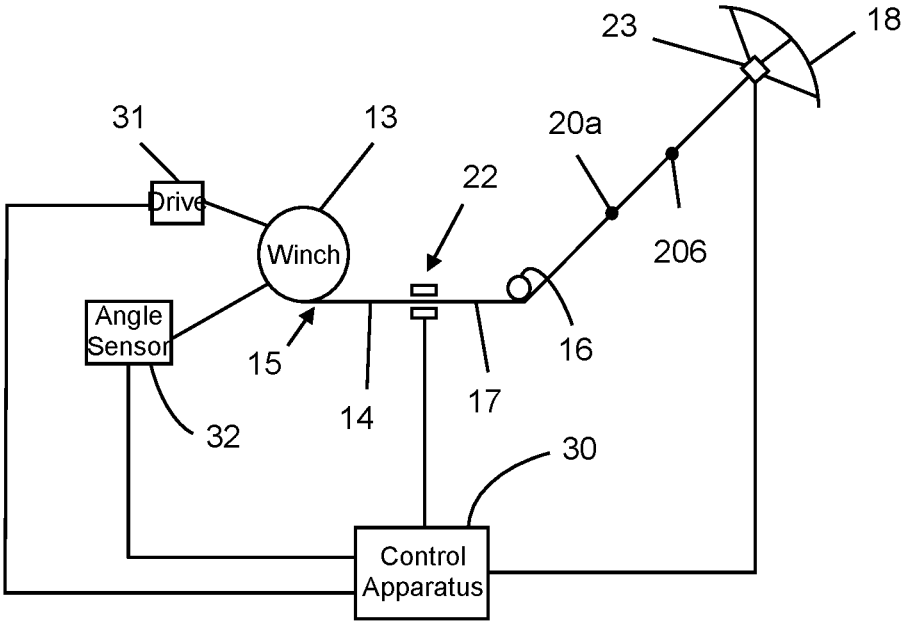
FIG. 1 shows a schematic view of an embodiment.

FIG. 1 shows a schematic view of a first embodiment of the system for controlling a rotary drum. The system comprises a rotary drum configured as a rope winch 13. A synthetic fiber rope 14 is wound partially onto the rope winch 13. The rope winch 13 has a drive 31, which drives the rope winch 13 to execute a winding movement. The drive is connected to a control apparatus 30, such that the control apparatus 30 can control the rope winch 13 to wind up or unwind the rope 14. The system moreover has an angle sensor 32, which is connected to the rope winch 13. The angle sensor detects the angle position of the rope winch and is configured to output a corresponding angle signal to the control apparatus 30.

The rope is guided along a defined path 17 from a rope feed position 15 of the rope winch 13 as far as a deflection roller 16. The deflection roller 16 forms a hauling point within the meaning of the present invention. A wind-attacked element 18 is secured to the end of the rope 14 remote from the traction rope winch 13. The wind-attacked element 18 is influenced by wind, such that it exerts a traction force on the rope 14. The wind-attacked element 18 has a control pod 23 from which the rope 14 fans out in a plurality of control lines that are connected to the wind-attacked element 18. The control pod 23 is configured in a known manner to shorten or lengthen the control lines in order to control the wind-attacked element 18. The control pod 23 receives commands from the control unit 30 via a wireless connection.

The rope 14 is provided with a first marking 20*a* and with a second marking 20*b* spaced apart from the first marking. The spacing between the markings 20*a*, 20*b* is approximately 19 m. A sensor 22 is arranged in the region of the defined path 17 and is connected to the control unit. By suitable unwinding or winding up of the rope 14, the markings 20*a*, 20*b* can be guided past the sensor 22. The sensor 22 is configured to detect the markings 20*a*, 20*b* as they pass it and to output a length signal to the control unit upon detection of the markings. For this purpose, the markings 20*a*, 20*b* are formed by metallic elements which are integrated in the synthetic fiber rope 14, wherein the sensor is configured as an inductive sensor.

Proceeding from the situation shown in FIG. 1, the function of the system during the hauling in and docking of the wind-attacked element 18 is explained below. To haul in the wind-attacked element, the rope 14 is wound up by means of suitable actuation of the drive 31. The marking 20*a* then approaches the sensor 22. When the marking 20*a* passes the sensor, the sensor 22 outputs a first length signal to the control unit 30, whereupon the control unit 30 retrieves the instantaneous angle position of the rope winch 13 via the angle sensor 32. When the rope 14 is hauled in further and the second marking 20*b* passes the sensor, the latter outputs a second length signal to the control unit 30, whereupon the control unit 30 again retrieves the instantaneous angle position of the rope winch 13 via the angle sensor 32. On the basis of the two retrieved angle positions, the control unit 30 then calculates an angle difference. This angle difference is then compared to the known spacing between the markings 20*a*, 20*b* in order to ascertain an "effective drum circumference". As the rope 14 is hauled in further in order to dock the wind-attacked element 18 to a docking adapter (not shown in FIG. 1), the ascertained "effective drum circumference" is taken into consideration. With the aid of the system, the docking can in this way take place with great precision.

The rope can be hauled in at great speed until the marking 22*b* is detected by the sensor 22. When the marking 22*b* is detected by the sensor 22, the wind-attacked element is still approximately 5 m from its docking position. This distance is sufficient for "braking" the wind-attacked element, in order thereafter to dock it safely taking into account the determined "effective drum circumference".

Figure 2:
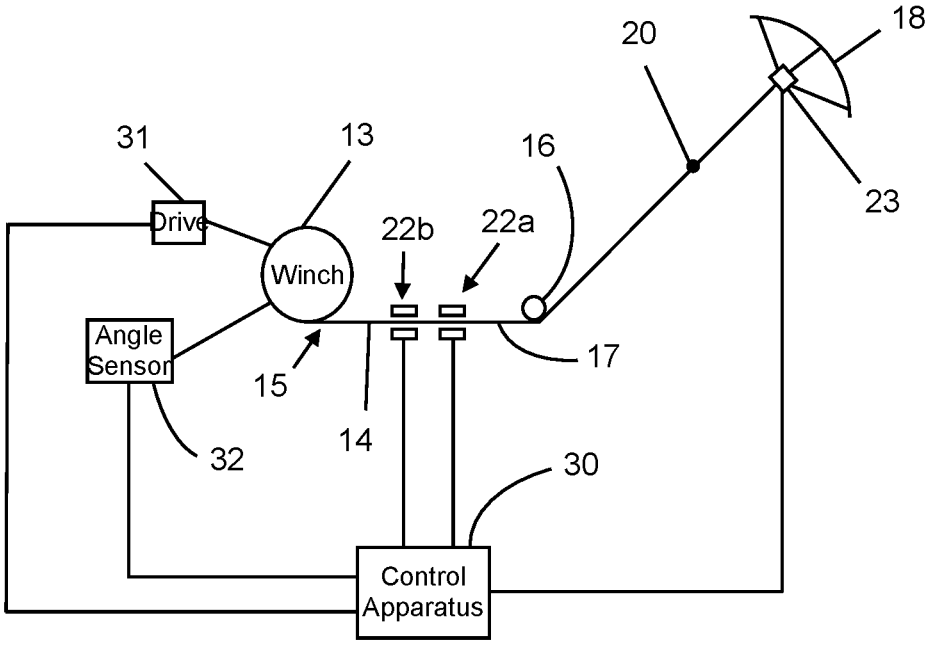
FIG. 2 shows an alternative embodiment in a schematic view.

FIG. 2 shows a schematic view of an alternative embodiment. The second embodiment differs from the first embodiment in that the rope 14 has only one marking 20. Moreover, in contrast to the first embodiment, two sensors 22*a*, 22*b* are arranged spaced apart from each other along the defined path 17. The sensors 22*a*, 22*b* are configured to detect the marking 20 and to output a length signal to the control unit 30. In contrast to the first embodiment, the angle difference is determined by retrieving the angle position upon detection of the marking 20 by the first sensor 22*a* and by subsequently retrieving the angle position upon detection of the marking 20 by the second angle sensor 22*b*. In order to determine the effective drum circumference, the angle difference is then compared to the spacing of the sensors 22*a*, 22*b* along the defined path 17. In other respects, the function of this embodiment corresponds to that of FIG. 1.

The invention claimed is:

1. A method for controlling the winding/unwinding of a rope portion onto/from a rotary drum, said method comprising the following steps:

a. making available a rope which is at least partially wound onto a rotary drum, wherein the rope is guided from the rotary drum along a defined path as far as a hauling point, wherein a traction force acts on the rope beyond the hauling point;

b. unwinding or winding the rope by executing a rotation of the rotary drum, such that a defined rope portion is moved along the defined path;

c. determining the length of the defined rope portion in the region of the defined path;

d. determining an angle difference corresponding to the rotation executed in step b.;

e. controlling the rotary drum for further winding/unwinding taking into account the length and the angle difference determined in steps c. and d.

2. The method as claimed in claim 1, in which the rope has a first marking and a second marking spaced apart from the first marking to define a known spacing, wherein the defined path has a sensor position, and wherein in step b. the rope is unwound or wound up such that the first marking passes the sensor position and the second marking passes or at least reaches the sensor position, wherein the first marking and the second marking are detected as they pass or reach the sensor position, wherein the length in step c. is determined by the known spacing of the markings, and wherein the angle difference between a first angle position of the rotary drum upon detection of the first marking and a second angle position of the rotary drum upon detection of the second marking is determined.

3. The method as claimed in claim 2, in which the known spacing between the markings is corrected taking into account a rope elongation.

4. The method as claimed in claim 1, in which the rope has one marking, wherein the defined path has a first sensor position and a second sensor position spaced apart from the first sensor position to define a spacing, wherein in step b. the rope is unwound or wound up such that the marking passes the first sensor position and passes or at least reaches the second sensor position, wherein the marking is detected as it passes or reaches the sensor positions, wherein the length in step c. is determined by the sensor spacing of the sensor positions, and wherein the angle difference between a first angle position of the rotary drum upon detection of the marking at the first sensor position and a second angle position of the rotary drum upon detection of the marking at the second sensor position is determined.

5. The method as claimed in claim 1, in which the traction force is exerted by a free-flying wind-attacked element secured to the rope.

6. The method as claimed in claim 5, further comprising hauling in the rope and in which the wind-attacked element, from a free-flying state, is docked to a docking adapter during the step of hauling in the rope, wherein the detection of the marking or of the markings is carried out during the hauling-in of the rope, and wherein the wind-attacked element is docked taking into account the length and the angle difference determined in steps c. and d.

7. A system for controlling the winding/unwinding of a rope portion onto/from a rotary drum, said system comprising a rotary drum with a rope that can be wound onto/unwound from the rotary drum, and with an angle sensor for detecting a rotation angle of the rotary drum and for outputting an angle signal, characterized in that the system has a hauling point, a length-measuring device and a control unit, wherein the rope is guided from the rotary drum along a defined path to the hauling point, wherein the length-measuring device is configured to determine a length of a defined rope portion extending along the defined path upon rotation of the rotary drum and to output a length signal, wherein the control unit is configured to receive the angle signal and the length signal and also to control the rotary drum taking into account the length signal and the angle signal.

8. The system as claimed in claim 7, in which the length-measuring device has a sensor, wherein the rope has a first marking and a second marking spaced apart from the first marking to define a marking spacing, wherein the sensor for detecting the markings is arranged in a region of the defined path and is configured to output a first length signal upon detection of the first marking and to output a second length signal upon detection of the second marking, wherein the control unit is configured to determine an angle difference based on the angle signal and the length signals.

9. The system as claimed in claim 7, in which the length-measuring device has a first sensor and a second sensor spaced apart from the first sensor to define a sensor spacing, wherein the rope has one marking, wherein the first sensor for detecting the marking is arranged in the region of the defined path and is configured to output a first length signal, wherein the second sensor for detecting the marking is arranged in the region of the defined path and is configured to output a second length signal, wherein the control unit is configured to determine an angle difference based on the angle signal and the length signals.

10. The system as claimed in claim 7, which has a wind-attacked element connected to the rope and configured to fly freely in a free-flying, wherein the wind-attacked element, from the free-flying state, is docked to a docking adapter when the rope is hauled in.

11. The system as claimed in claim 10, in which the marker spacing between the first marking and the second marking is between 1 m and 30 m, or in which the sensor spacing between the sensors is between 0.1 m and 5 m.

12. The system as claimed in claim 10, in which the marking, or the marking lying remote from the rotary drum, is at a securing spacing from a securing point at which the rope is connected to the wind-attacked element, which securing spacing is between 5 m and 40 m.

13. The system as claimed in claim 10, in which a first spacing between the marking lying remote from the rotary drum and the sensor, or a second spacing between the sensor position lying remote from the rotary drum and the marking, is at least 2 m, when the wind-attacked element is docked to the docking adapter.

14. Employing the system as claimed in claim 7 further comprising a wind-attacked element docked to a docking adapter.

15. The method as claimed in claim 2, in which the traction force is exerted by a free-flying wind-attacked element secured to the rope.

16. The method as claimed in claim 3, in which the traction force is exerted by a free-flying wind-attacked element secured to the rope.

17. The method as claimed in claim 4, in which the traction force is exerted by a free-flying wind-attacked element secured to the rope.

18. The system as claimed in claim 8, which has a wind-attacked element connected to the rope and configured to fly freely in a free-flying, wherein the wind-attacked element, from the free-flying state, is docked to a docking adapter when the rope is hauled in.

19. The system as claimed in claim 9, which has a wind-attacked element connected to the rope and configured to fly freely in a free-flying, wherein the wind-attacked element, from the free-flying state, is docked to a docking adapter when the rope is hauled in.

20. The system as claimed in claim 11, in which the marking, or the marking lying remote from the rotary drum, is at a securing spacing from a securing point at which the rope is connected to the wind-attacked element, which securing spacing is between 5 m and 40 m.

* * * * *